US006575716B1

(12) United States Patent
Morita et al.

(10) Patent No.: US 6,575,716 B1
(45) Date of Patent: Jun. 10, 2003

(54) LINEAR COMPRESSOR

(75) Inventors: Ichiro Morita, Fujisawa (JP); Masanori Kobayashi, Fujisawa (JP); Ko Inagaki, Fujisawa (JP); Makoto Katayama, Chigasaki (JP); Akira Hayashi, Fujisawa (JP)

(73) Assignee: Matsushita Refrigeration Co., Osaka (JP)

( * ) Notice: Subject to any disclaimer, the term of this patent is extended or adjusted under 35 U.S.C. 154(b) by 0 days.

(21) Appl. No.: 09/857,027

(22) PCT Filed: Nov. 30, 1999

(86) PCT No.: PCT/JP99/06681

§ 371 (c)(1),
(2), (4) Date: Jul. 16, 2001

(87) PCT Pub. No.: WO00/32934

PCT Pub. Date: Jun. 8, 2000

(30) Foreign Application Priority Data

Dec. 1, 1998 (JP) ..... 10-341232

(51) Int. Cl.[7] ..... F04B 35/04
(52) U.S. Cl. ..... 417/417; 92/127; 92/DIG. 2
(58) Field of Search ..... 417/416, 417, 417/418; 92/127, 158, 165 R, DIG. 2

(56) References Cited

U.S. PATENT DOCUMENTS

| | | | | | |
|---|---|---|---|---|---|
| 3,573,514 | A | * | 4/1971 | Race | 417/417 |
| 4,163,911 | A | * | 8/1979 | Simes et al. | 417/417 |
| 4,644,851 | A | * | 2/1987 | Young | 92/127 |
| 4,873,913 | A | * | 10/1989 | Pruitt et al. | 92/158 |
| 4,969,807 | A | * | 11/1990 | Kazumoto et al. | 417/417 |
| 5,257,915 | A | * | 11/1993 | Laskaris et al. | 417/418 |
| 5,772,410 | A | | 6/1998 | Chang | |
| 6,012,280 | A | * | 1/2000 | Hufton | 92/DIG. 2 |

FOREIGN PATENT DOCUMENTS

| | | |
|---|---|---|
| JP | 8-200224 | 8/1996 |
| JP | 9-195928 | 7/1997 |
| JP | 10-299649 | 11/1998 |

* cited by examiner

*Primary Examiner*—Michael Koczo
(74) *Attorney, Agent, or Firm*—Wenderoth, Lind & Ponack, L.L.P.

(57) ABSTRACT

In a linear compressor having a compression mechanism for compressing and discharging a refrigerant, an inflammable refrigerant or a natural refrigerant such as propane, isobutane, carbon dioxide or the like is used as the refrigerant while no lubricating oil is filled up, thereby improving the system efficiency and reducing the amount of refrigerant.

4 Claims, 5 Drawing Sheets

LINEAR COMPRESSOR

TECHNICAL FIELD

The present invention relates to a linear compressor (vibration type compressor) for use in a refrigerator-freezer, an air conditioner or the like.

BACKGROUND ART

A refrigerant CFC-12 (dichlorodifluoromethane, $CCI_2F_2$) or HCFC-22 monochlorodifluoromethane, $CHCIF_2$) has been primarily utilized in conventional compressors for use in a refrigerating cycle or the like. However, in view of the influence of ozone layer damage on the human body or other living things or on the global warming, an HFC-based refrigerant containing no chlorine (CI) atoms in a molecule, such as HFC-134*a* (1,1,1,2-tetrafluoroethane, $CH_2FCF_3$), has come to be used.

In recent years, as disclosed in Japanese Laid-open Patent Publication No. 8-200224, an inflammable refrigerant such as propane or isobutane or a natural refrigerant is gradually utilized in reciprocating compressors, rotary compressors, scroll compressors or helical blade compressors.

As compressors other than those referred to above, Japanese Laid-open Utility Model Publication No. 58-116784 discloses a linear compressor.

A conventional linear compressor is explained hereinafter with reference to the drawings.

FIG. 6 depicts a conventional linear compressor having a compression mechanism 1 that includes a motor 3, a cylinder 5, a bearing 6, a piston 8, a cylinder head 10 and a resonant spring 11, and is elastically supported by suspension springs (not shown) within a closed casing 2. The motor 3 includes a stationary element 4 and a movable element 7 secured to the piston 8.

The cylinder 5 and the bearing 6 axially movably support the piston 8. The resonant spring 11 has one end secured to the movable element 7 of the motor 3 and the other end secured to the bearing 6, and a portion thereof is submerged under lubricating oil 12 stored within the closed casing 2. 8*a* denotes a compression chamber defined by the cylinder 5 and the piston 8. A refrigerant gas introduced into the compression chamber 8*a* through a suction hole 8*b* in the piston 8 is compressed via a reciprocating motion of the piston 8.

The lubricating oil 12 stored at a lower portion within the closed casing 2 is stirred by expansion and contraction of the resonant spring 11 following the axial reciprocating motion of the piston 8. The lubricating oil 12 then scatters within the closed casing 2 to lubricate the sliding portions between the piston 8 and the cylinder 5, and the sliding portions between the piston 8 and the bearing 6.

The refrigerant used is CFC-12 or HCFC-22 that has been hitherto used primarily in a cooling system, while mineral oil is primarily used for the lubricating oil 12.

Cast iron or an aluminum-based alloy is used for the sliding members constituting the sliding portions such as the cylinder 5, piston 8, bearing 6 and the like. In some cases, surface treatment such as manganese phosphate-based chemical conversion coating is applied thereto.

However, the lubricating oil 12 is used in the conventional linear compressors, and some lubricating oil is used in the compressors such as the reciprocating compressors, rotary compressors, scroll compressors or helical blade compressors, in which a natural refrigerant or an inflammable refrigerant is used. The use of the lubricating oil 12 lowers the heat exchanging efficiency in the cooling system, thus giving rise to the possibility of lowering the efficiency of the cooling system.

By way of example, considering the case where the aforementioned refrigerant is used in the compressors, for example, the conventional linear compressors, in which an inflammable refrigerant or natural refrigerant such as propane, isobutane, carbon dioxide or the like is used, the inflammable refrigerant or natural refrigerant dissolves in the lubricating oil 12 within the compressors. In particular, hydrocarbons dissolve in the lubricating oil 12 in larger amount than other refrigerants. Because of this, the amount of refrigerant required for the cooling system must be increased by the amount that dissolves in the lubricating oil, compared with the cooling system in which no lubricating oil is used. In particular, when hydrocarbons are used, it has been considered that the amount of refrigerant must be further increased.

The use of an increased amount of the natural refrigerant or inflammable refrigerant results in an increase in cost, and if the refrigerant leaks, there is a possibility of catching fire or explosion.

Furthermore, because the compression mechanism 1 is arranged horizontally in the conventional linear compressors, a lateral load is applied to the sliding portions between the piston 8 and the cylinder 5 and between the piston 8 and the bearing 6 by the weight of the piston 8, the movable element 7 of the motor 3 and the like. This increases the sliding loss, and if no lubricating oil is used, there is a good chance that the sliding portions may be subjected to wear or seizing.

The present invention has been developed to overcome the above-described disadvantages.

It is accordingly an objective of the present invention to provide an inexpensive, safe and highly reliable linear compressor capable of reducing the amount of refrigerant for use in the cooling system, improving the heat exchanging efficiency in the cooling system, and also improving the efficiency of the whole cooling system.

DISCLOSURE OF THE INVENTION

In accomplishing the above objective, the linear compressor according to the present invention is characterized by including a closed casing and a compression mechanism arranged vertically within the closed casing for compressing and discharging a refrigerant, wherein an inflammable refrigerant or a natural refrigerant is used as the refrigerant while no lubricating oil is filled up.

According to the above-described construction, because no lubricating oil is used, the heat exchanging efficiency in a cooling system is improved and the efficiency of the whole cooling system is improved. Furthermore, because the refrigerant does not dissolve in the lubricating oil, the amount of refrigerant to be used in the cooling system is reduced, and the cost is also reduced. Even if the refrigerant leaks, the possibility of catching fire or exploding is reduced, enhancing the safety.

The use of propane, isobutane or carbon dioxide for the refrigerant does not cause any problem associated with ozone layer damage, thus enhancing the safety.

If a sliding surface in the compression mechanism is surface-treated with Teflon TM (polytetrafluoroethylene), molybdenum disulfide and alumite, the self-lubricating effect of a surface-treating agent prevents abnormal wear at the sliding portion of a piston and a cylinder even without any lubricating oil, thus enhancing the reliability. Also, the surface treatment reduces the coefficient of friction on the sliding portion and reduces the sliding loss, thus enhancing the compressor efficiency.

In another aspect of the present invention, a linear compressor is characterized by including a closed casing, a compression mechanism arranged horizontally within the closed casing for compressing and discharging a refrigerant, and means for reducing a lateral load applied to a sliding surface in the compression mechanism, wherein an inflammable refrigerant or a natural refrigerant is used as the refrigerant while no lubricating oil is filled up.

According to the above-described construction, because no lubricating oil is used, the heat exchanging efficiency in a cooling system is improved and the efficiency of the whole cooling system is improved. Furthermore, because the refrigerant does not dissolve in the lubricating oil, the amount of refrigerant to be used in the cooling system is reduced, and the cost is also reduced. Even if the refrigerant leaks, the possibility of catching fire or exploding is reduced, enhancing the safety.

DETAILED DESCRIPTION OF THE PREFERRED EMBODIMENTS

Preferred embodiments of a linear compressor (vibration type compressor) according to the present invention are discussed hereinafter with reference to the drawings.

Embodiment 1

Figure 1:
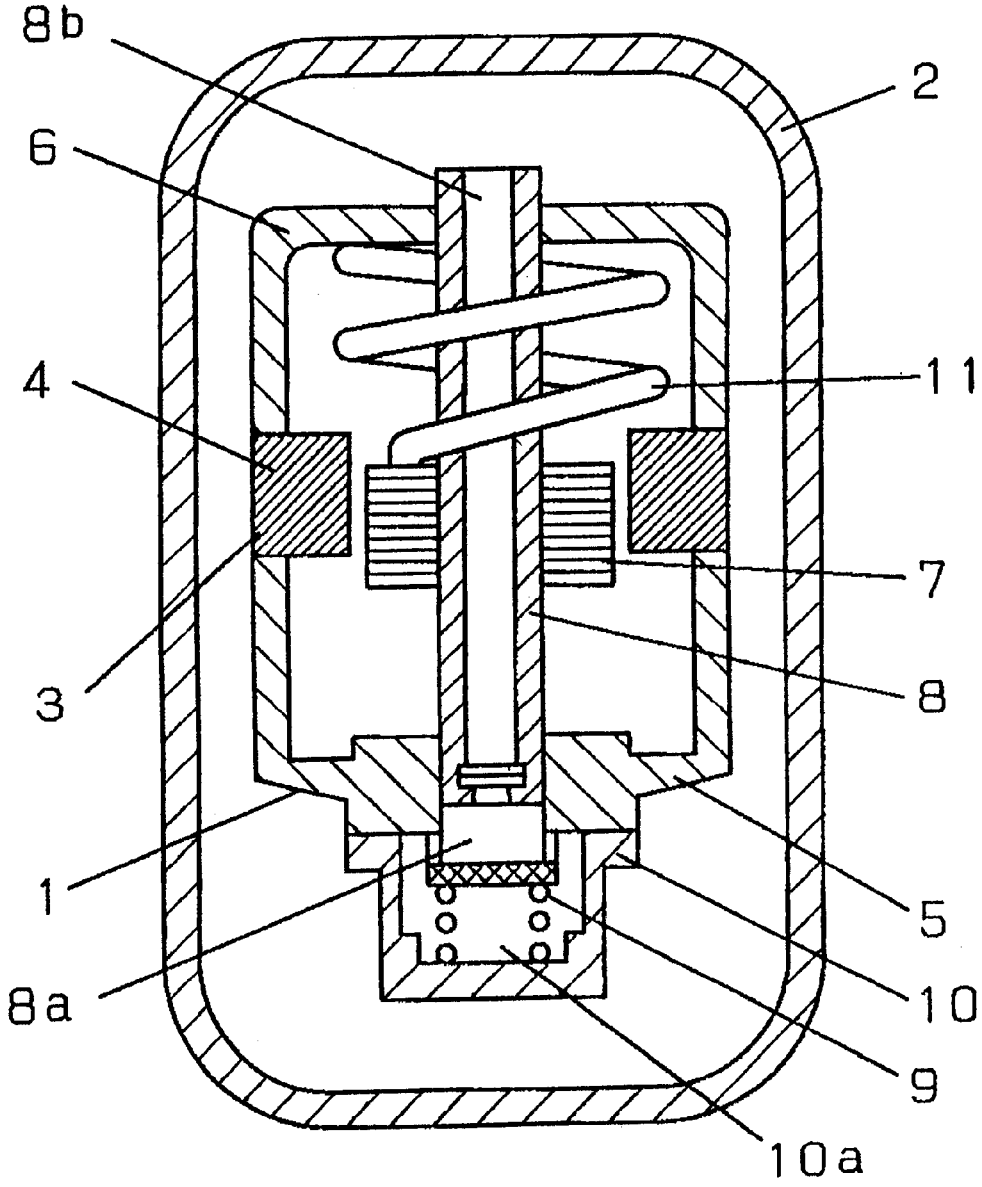
FIG. 1 is a vertical sectional view of a linear compressor according to a first embodiment of the present invention.

FIG. 1 depicts a linear compressor according to a first embodiment of the present invention, which includes a compression mechanism 1 arranged vertically within a closed casing 2. The compression mechanism 1 includes a motor 3, a cylinder 5, a bearing 6, a piston 8, a cylinder head 10 and a resonant spring 11, and is elastically supported by suspension springs (not shown) within the closed casing 2. The motor 3 includes a stationary element 4 and a movable element 7 secured to the piston 8.

The piston 8 is axially slidably supported by the cylinder 5 and the bearing 6. The resonant spring 11 has one end secured to the movable element 7 of the motor 3 and the other end secured to the bearing 6. 8*a* denotes a compression chamber defined by the cylinder 5 and the piston 8. A refrigerant gas introduced into the compression chamber 8*a* through a suction hole 8*b* axially defined in the piston 8 is compressed via a reciprocating motion of the piston 8.

The refrigerant compressed by and discharged from the compression mechanism 1 is an inflammable refrigerant or natural refrigerant such as propane, isobutane, carbon dioxide or the like. No lubricating oil is filled up.

In the linear compressor of the above-described construction, the piston 8 is driven by the motor 3 to undergo an axial reciprocating motion in the cylinder 5 and the bearing 6 while receiving an axial elastic force of the resonant spring 11. Accordingly, only an axial force is applied to the piston 8 from the motor 3 and the resonant spring 11. Furthermore, a pressure of the gas within the compression chamber 8*a* and that of the gas within the closed casing 2 are also applied to end faces of the piston 8. Such pressures are also axial loads. Because the compression mechanism 1 is arranged vertically, the weight of the piston 8 does not act in a direction perpendicular to the axial direction of the piston 8. Because of this, no lateral load is applied to the sliding portions between the piston 8 and the cylinder 5 or the bearing 6 during the axial reciprocating motion of the piston 8.

Accordingly, even without any lubricating oil on the sliding portions between the piston 8 and the cylinder 5 or the bearing 6, the compressor can be operated without causing wear or seizing, while maintaining a slight radial clearance. Because no lubricating oil is used in the cooling system, the heat exchanging efficiency in the cooling system is improved, and the efficiency of the whole cooling system is improved.

Even if a natural refrigerant or inflammable refrigerant such as propane, isobutane, carbon dioxide or the like, the use of which is preferable from the viewpoint of protection of the global environment, is used, the refrigerant never dissolves in a lubricating oil, because no lubricating oil is used. Accordingly, the amount of refrigerant required for the cooling system can be reduced, compared with a cooling system utilizing a lubricating oil, by the amount that dissolves in the lubricating oil. In particular, because hydrocarbons dissolve in the lubricating oil in larger amount than other refrigerants, the amount thereof can be considerably reduced.

Accordingly, the amount of a natural refrigerant or inflammable refrigerant to be used in the cooling system can be reduced, and the cost can also be reduced. Even if the refrigerant leaks, the possibility of catching fire or exploding can be reduced.

Moreover, in applications where the use of a vertically arranged compressor mechanism is desired in view of the installation space for the compressor in the cooling system, it is preferred that the linear compressor according to this embodiment be used.

Embodiment 2

Figure 2:
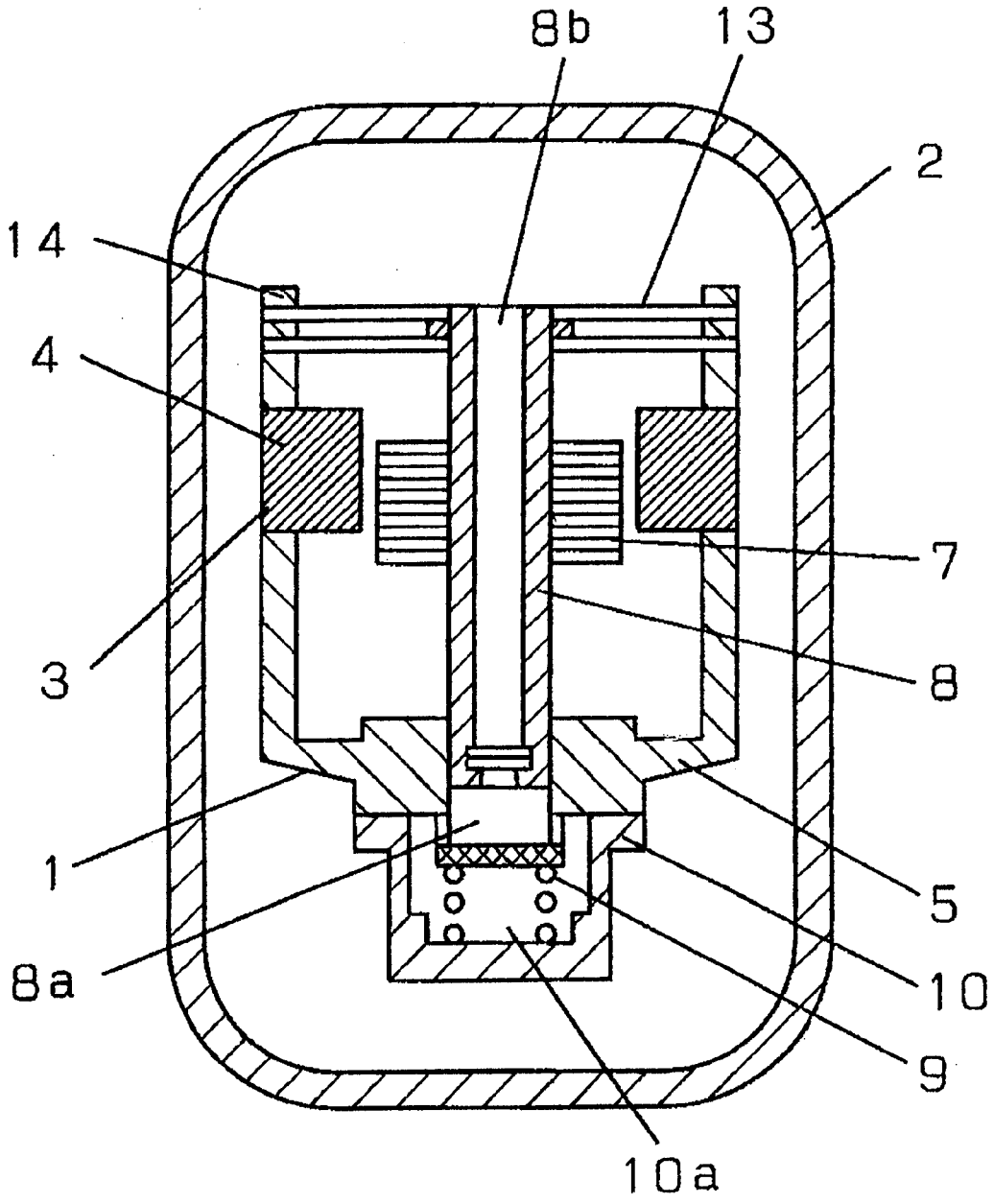
FIG. 2 is a vertical sectional view of a linear compressor according to a second embodiment of the present invention.

FIG. 2 depicts a linear compressor according to a second embodiment of the present invention, in which the compression mechanism 1 is vertically arranged within the closed casing 2, as in the linear compressor of FIG. 1.

Because the construction of the linear compressor of FIG. 2 is basically the same as that of the linear compressor of FIG. 1, only differences therebetween are discussed hereinafter.

In this embodiment, an elastic member 13 such, for example, as a leaf spring is used in place of the bearing 6 and the resonant spring 11, both shown in FIG. 1. An inner peripheral portion of the elastic member 13 is connected to the piston 8, while an outer peripheral portion of the elastic member 13 is connected to an elastic anchoring member 14 mounted on the cylinder 5. By this construction, the piston 8 is radially supported by the elastic member 13 as if it is supported by a bearing, and the piston 8 receives an axial elastic force with an axial displacement thereof. The piston 8 slides only with respect to the cylinder 5 and, hence, the number of sliding portions is reduced compared with the first embodiment.

By the above-described construction, the piston 8 is driven by the motor 3 to undergo an axial reciprocating motion and slides in the cylinder 5 while receiving an axial elastic force of the elastic member 13 acting counter to the movement thereof. Accordingly, only the axial force is applied to the piston 8 by the motor 3 and the elastic member 13.

As is the case with the first embodiment, because no lateral load is applied to the piston 8, even if no lubricating oil exists on the sliding portion between the piston 8 and the cylinder 5, the compressor can be operated without causing wear or seizing, while maintaining a slight radial clearance. In particular, the sliding portion is present only between the piston 8 and the cylinder 5 and, hence, compressor operation without any lubricating oil can be conducted more easily than that in the first embodiment.

Embodiment 3

Figure 3:
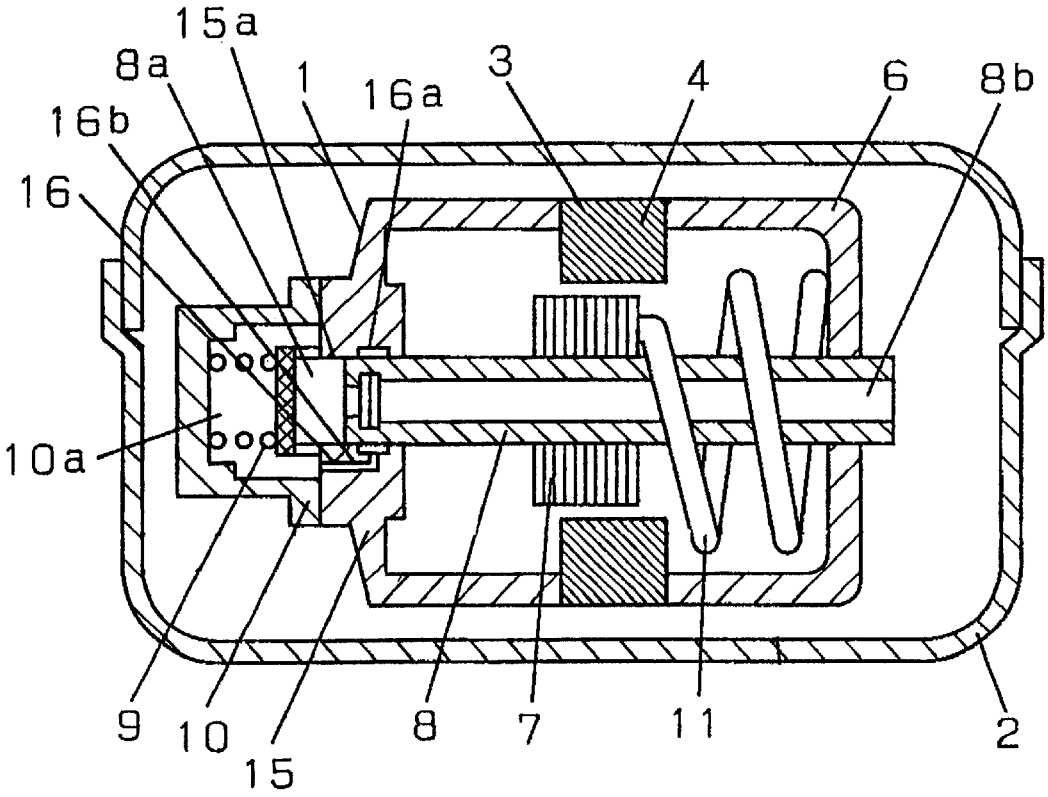
FIG. 3 is a vertical sectional view of a linear compressor according to a third embodiment of the present invention.

FIG. 3 depicts a linear compressor according to a third embodiment of the present invention, in which the compression mechanism 1 is arranged horizontally within the closed casing 2.

Although the linear compressor of FIG. 3 differs in the manner of installation from the linear compressor of FIG. 1, the basic construction is the same. Accordingly, only differences are discussed hereinafter.

In this embodiment, a cylinder 15 is provided with means 16 for reducing a lateral load acting thereon at the sliding portion with the piston 8. More specifically, the cylinder 15 has an annular groove 16*a* defined therein at the sliding portion thereof, i.e., an inner surface thereof 15*a*, and also has a communication passageway 16*b* defined therein, one end of which communicates with a high-pressure portion 10*a* within the cylinder head 10 and the other end of which communicates with the annular groove 16*a* of the cylinder 15.

In the linear compressor of the above-described construction, the piston 8 is driven by the motor 3 to undergo an axial reciprocating motion in the cylinder 15 and the bearing 6. Accordingly, an axial force is applied to the piston 8 by the motor 3. Furthermore, because the compression mechanism 1 is arranged horizontally as in the conventional linear compressor, the weight of the piston 8 results in a lateral load acting thereon in a direction perpendicular to the axial direction.

However, a high-pressure refrigerant compressed by the reciprocating motion of the piston 8 and discharged into the cylinder head 10 is introduced into the annular groove 16*a* in the inner surface 15*a* of the cylinder 15 via the communication an passageway 16*b* due to a pressure difference. That is, the high-pressure refrigerant is discharged into the slight radial clearance at the sliding portions between the cylinder 15 and the piston 8. This high-pressure refrigerant forms an air bearing for receiving the lateral load 8 on the piston 8.

Accordingly, with the construction in which the compression mechanism 1 is arranged horizontally, even if the lateral load is applied to the piston 8 in a direction perpendicular to the axial direction, the air bearing can considerably reduce the lateral load acting on the sliding portion of the piston 8. Because of this, even if the compression mechanism 1 is arranged horizontally as in the conventional compressor, and even if no lubricating oil exists on the sliding portions of the piston 8 and the cylinder 5, the compressor can be operated without causing wear or seizing, while maintaining the slight radial clearance.

Although in this embodiment the cylinder 15 is provided with the air bearing as the means 16 for reducing the lateral load on the sliding portions, the same effect can be obtained even if the air bearing is provided in the piston 8 or the bearing 6.

In place of the air bearing, the same effect can be obtained by providing the sliding portions between the piston 8 and the cylinder 15 or the bearing 6 with dynamic pressure generating grooves as means for generating dynamic pressure upon a reciprocating motion of the piston 8. Any other mechanisms or constructions are applicable if they can reduce the lateral load on the sliding portions of the piston 8.

Furthermore, the lateral load on the sliding portions of the piston 8 can also be reduced by reducing the weight of the reciprocating members. For this purpose, the piston 8 may be formed of a material such as aluminum having a small specific gravity, or the weight of the movable element 7 of the motor 3 may be reduced.

Moreover, in applications where the use of a horizontally arranged compressor mechanism is desired in view of the installation space for the compressor in the cooling system, it is preferred that the linear compressor according to this embodiment be used.

Embodiment 4

Figure 4:
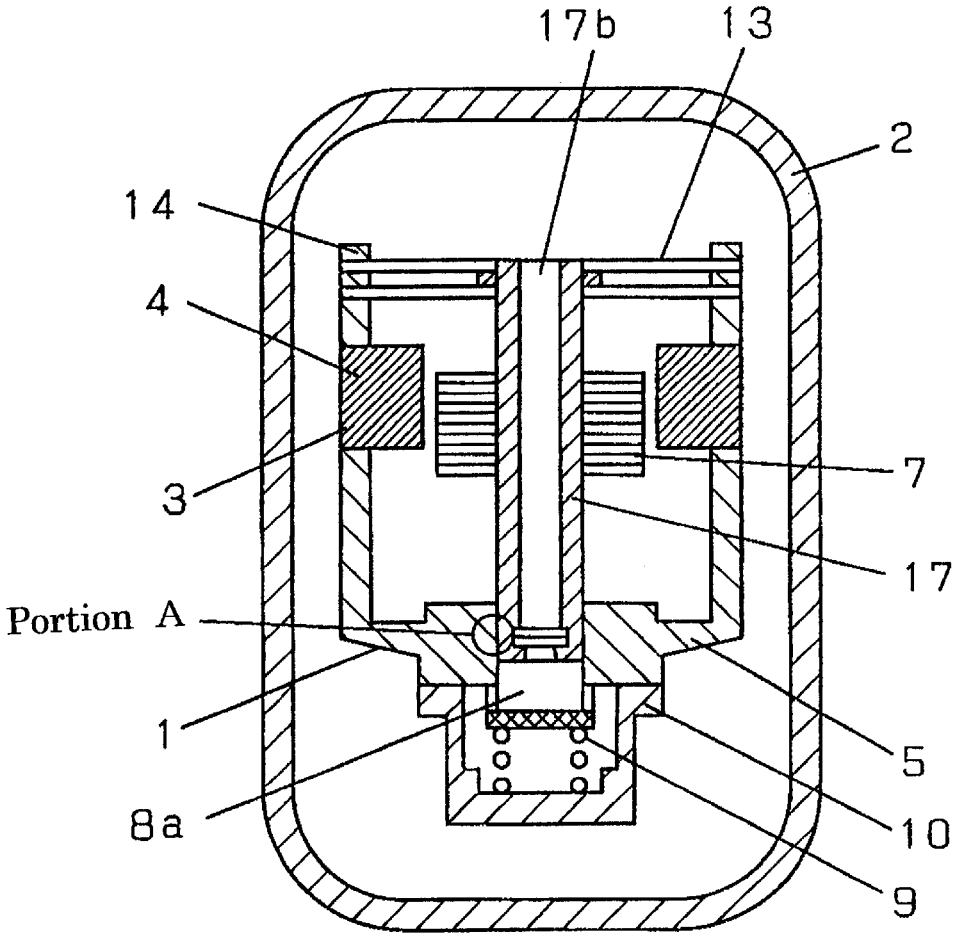
FIG. 4 is a vertical sectional view of a linear compressor according to a fourth embodiment of the present invention.
Figure 5:
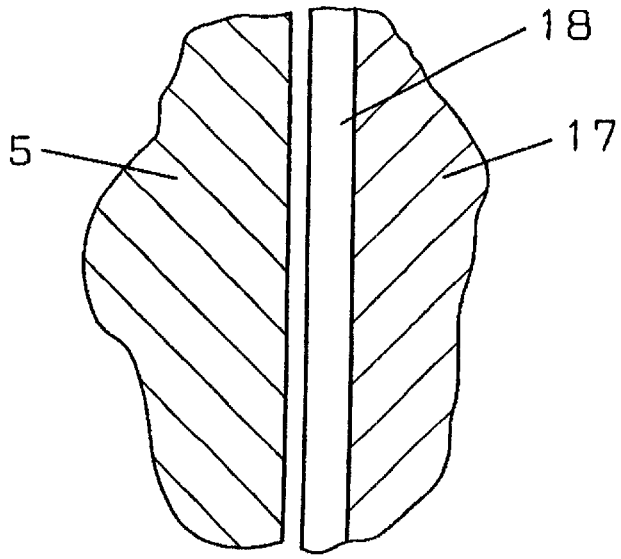
FIG. 5 is an enlarged view of an outer peripheral portion of a piston shown in FIG. 4.
Figure 6:
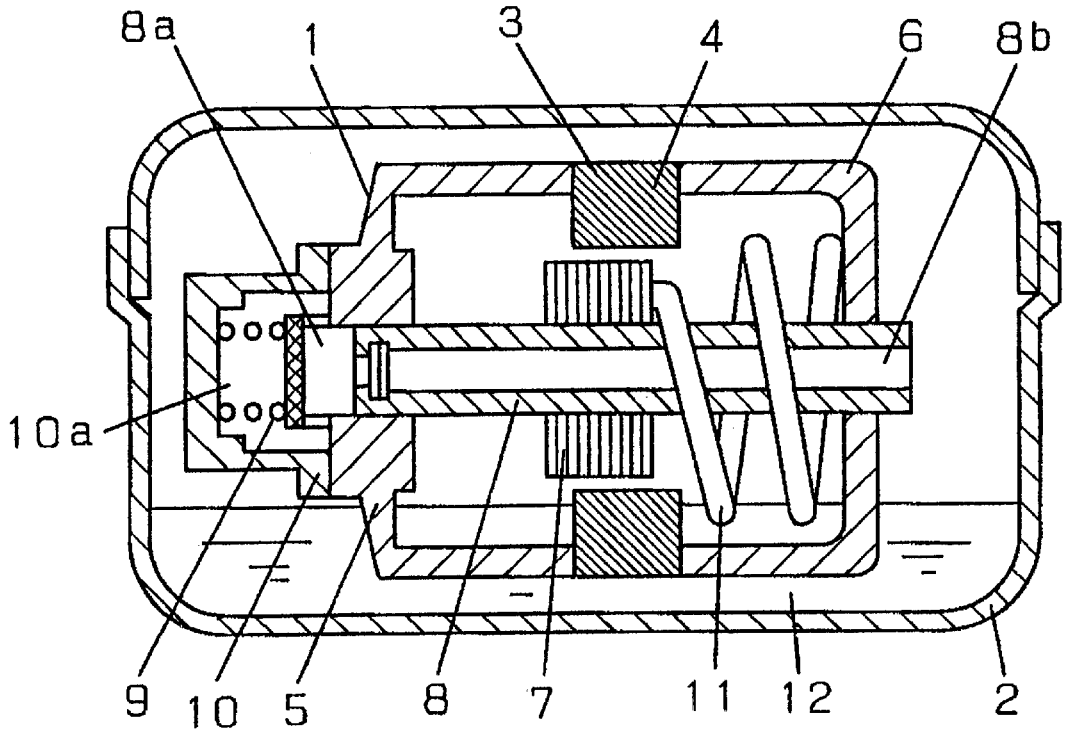
FIG. 6 is a vertical sectional view of a conventional linear compressor.

FIG. 4 depicts a linear compressor according to a fourth embodiment of the present invention, and FIG. 5 is an enlarged view of a portion A in FIG. 4.

The linear compressor according to this embodiment resembles the linear compressor according to the second embodiment in the basic construction, but differs in that a piston 17 was surface-treated to have a surface-treated layer 18 formed on a sliding portion thereof using Teflon™, molybdenum disulfide or alumite.

Even if seizing occurs on the sliding portions due to poor assembling accuracy or machining accuracy for the cylinder 5 and the piston 17, or even if a lateral load is applied to the sliding portions of the piston 17 for some reason during operation, the self-lubricating effect of the surface-treated layer 18 of Teflon™, molybdenum disulfide or alumite can prevent abnormal wear at the sliding portions of the piston 17 and the cylinder 5 even without any lubricating oil.

Also, the surface-treated layer 18 acts to reduce the coefficient of friction with respect to the cylinder 5. As a result, the sliding loss is reduced, enhancing the compressor efficiency.

Although in this embodiment the sliding portion of the piston was surface-treated, the same effect can be obtained by similarly surface-treating the sliding portion of the cylinder.

Furthermore, even in the linear compressor according to the first or third embodiment, the same effect can be obtained by similarly surface-treating the sliding portions of the piston, cylinder, bearing or the like.

What is claimed is:

1. A linear compressor comprising:

a closed casing;

a compression mechanism arranged within said closed casing for compressing and discharging a refrigerant, said compression mechanism comprising a cylinder having no lubricating oil located therein, a cylinder head mounted on said cylinder, and a piston for compressing the refrigerant, said cylinder head having a high pressure portion into which the refrigerant compressed by said piston is discharged, wherein said cylinder has a communication passageway defined therein for communicating said high pressure portion and contacting surfaces between said cylinder and said piston to reduce a lateral load applied to said cylinder, wherein one of an inflammable refrigerant and carbon dioxide is used as the refrigerant.

2. The linear compressor according to claim 1, wherein said cylinder has an annular groove defined therein at the sliding portion thereof, and wherein said communication passageway communicates said high pressure portion with said annular groove.

3. The linear compressor according to claim 1, wherein one of the contacting surfaces of said cylinder and said piston comprises a surface that has been surface-treated using one of polytetrafluoroethylene, molybdenum disulfide and alumite.

4. The linear compressor according to claim 1, wherein the inflammable refrigerant comprises propane or isobutane.

* * * * *